US006640974B2

(12) United States Patent
Malone

(10) Patent No.: US 6,640,974 B2
(45) Date of Patent: Nov. 4, 2003

(54) WALLET CARD PACKAGE WITH POUCH

(75) Inventor: Nicholas J. Malone, Rockford, MI (US)

(73) Assignee: Display Pack, Inc., Grand Rapids, MI (US)

( * ) Notice: Subject to any disclaimer, the term of this patent is extended or adjusted under 35 U.S.C. 154(b) by 65 days.

(21) Appl. No.: 09/973,511

(22) Filed: Oct. 9, 2001

(65) Prior Publication Data

US 2003/0066777 A1 Apr. 10, 2003

(51) Int. Cl.[7] ..... B65D 85/48
(52) U.S. Cl. ..... 206/449; 206/460
(58) Field of Search ..... 206/38, 39, 449, 206/454, 460, 461, 813; 235/380, 454, 486; 283/61, 62, 74, 75, 904

(56) References Cited

U.S. PATENT DOCUMENTS

| | | | | | |
|---|---|---|---|---|---|
| 3,089,459 | A | | 5/1963 | Picard | |
| 4,700,840 | A | * | 10/1987 | Haddock | 206/449 |
| 4,739,883 | A | | 4/1988 | Mohs et al. | |
| 5,038,926 | A | | 8/1991 | van der Toorn | |
| 5,080,223 | A | | 1/1992 | Mitsuyama | |
| 5,353,935 | A | | 10/1994 | Yeager et al. | |
| 5,506,395 | A | | 4/1996 | Eppley | |
| 5,551,595 | A | * | 9/1996 | Mertens et al. | 206/449 |
| 5,609,253 | A | * | 3/1997 | Goade, Sr. | 206/449 |
| 5,720,158 | A | | 2/1998 | Goade, Sr. | |
| 5,740,915 | A | | 4/1998 | Williams | |
| D394,387 | S | | 5/1998 | Williams | |
| 5,760,381 | A | | 6/1998 | Stich et al. | |
| 5,777,305 | A | | 7/1998 | Smith et al. | |
| 5,791,474 | A | | 8/1998 | Hansen | |
| 5,842,629 | A | | 12/1998 | Sprague et al. | |
| 5,918,909 | A | | 7/1999 | Fiala et al. | |
| 5,921,584 | A | | 7/1999 | Goade, Sr. | |
| 5,975,302 | A | | 11/1999 | Young | |
| 6,109,439 | A | | 8/2000 | Goade, Sr. | |
| 6,237,774 | B1 | * | 5/2001 | Stageberg | 206/499 |
| 6,291,171 | B1 | * | 9/2001 | Ricciardi et al. | 206/232 |
| 6,439,613 | B2 | * | 8/2002 | Klure | 283/62 |

* cited by examiner

*Primary Examiner*—Luan K. Bui
(74) *Attorney, Agent, or Firm*—Warner Norcross & Judd LLP

(57) ABSTRACT

A wallet card package having a card that is removably secured to the package so that it can be removed for activation and a pouch for rejoining the removed card with the package following activation. The card is preferably secured to the package by a peelable adhesive that permits the card to be readily removed from the package. The package preferably includes front and rear panels that cooperatively define a pouch for receiving the card after it has been removed. The present invention also discloses a method for packaging and activating a wallet card including the steps of (1) providing a wallet card having a machine-readable activation code, (2) removably securing the card to the package with the activation code being inaccessible for reading, (3) removing the card from the package, (4) reading the activation code from the card, and (5) rejoining the card to the package by inserting it into the pouch.

35 Claims, 11 Drawing Sheets

WALLET CARD PACKAGE WITH POUCH

BACKGROUND OF THE INVENTION

The present invention relates to product packaging and, more particularly, to packaging for wallet cards.

Wallet cards are commonly used as credit, debit, pre-paid and identification instruments. For example, wallet cards are increasingly used as pre-paid phone cards and can be carried in a wallet or purse. These cards are typically sold at retail and, once purchased, entitle the bearer to a specified value or amount of long distance phone service.

Historically, in order to access the value assigned to the card, the user was required to dial the phone number designated by the issuer of the phone card and enter a security code or identification number uniquely assigned to the telephone card. The phone number and security code were typically printed on the card. These cards, due to their relatively small size, were particularly susceptible to theft. Product packaging was used to address the theft problem. For example, phone cards were often packaged so that the card was totally enclosed and not accessible. A conventional package of this type included a pair of paperboard panels that were glued together about the phone card so that the phone card was sandwiched and securely retained between the panels. Alternatively, the card was sandwiched between one opaque panel and one transparent panel. Additionally, wallet cards were packaged inside a plastic bubble, or sandwiched between a plastic bubble and a cardboard panel. While secure, these packages met with limited success.

Today, each card is typically sold in an inactive state. At the time of purchase each card must be activated at the register before its value is accessible. This method is often referred to as "point-of-sale activation." Typically, point-of-sale activation is achieved through the use of a magnetic strip that is affixed to the wallet card and that can be run through a conventional card reader by the cashier at the time of purchase. When the card is swiped, the card reader automatically dials the activation telephone number encoded in the magnetic strip. Once the activation system is accessed, the card reader transmits the activation code encoded in the magnetic strip. The activation system then activates the purchased card, making its value accessible to the user.

Once the card is activated, the issuer tracks the value or amount of phone services used by the card holder and deducts the value or amount of those services from the designated value of the card. Once the value of the card had been exhausted, the card is rendered inactive by the issuer.

To facilitate activation of the phone card, magnetic swipe phone cards are generally packaged so that the magnetic strip is accessible without opening the product packaging. It has been recognized that the need to open the package for activation causes several problems. First, it takes time for the cashier to open the package to gain access to the card. Second, opening the package can destroy information printed on the packages, such as instructions, rates, advertising and other similar information. Third, when separated from the package, the card is more easily lost or misplaced, for example, in grocery bags. It also becomes easier to lose, misplace or inadvertently discard the package before any instructions or other information printed on the package is read by the consumer. Fourth, opened packages are undesirable when the pre-paid cards are purchased as gifts. As a result, a variety of wallet card packages have been developed that do not require separation of the card from the package to perform activation.

One type of conventional magnetic swipe phone card package includes a pair of paperboard panels that are sandwiched about an upper portion of the phone card. The lower portion of the phone card containing the magnetic strip (or other machine readable code) protrudes from the package. While convenient, the protruding card can be problematic. The exposed card can be damaged during shipping and handling. Further, the packaging costs are relatively high. For example, the paperboard panels must be die cut, the phone card must be precisely positioned between but sticking out from the panels, the panels must be intersecured and the phone card must be secured to the panels. Still further, removing the card from such a package is not easily accomplished without tearing the package and, thereby, damaging the information printed on the packaging. Additionally, the package can create complications during activation as sufficient clearance is not always available for swiping the card through the card reader while the card is still attached to the package.

A similar point-of-sale activation method is used with "gift" cards that have a bar code for activation purposes. These types of cards are packaged so that the bar code, rather than the magnetic strip, is accessible without opening the package. With this type of package, the bar code is scanned at the register at the time of purchase. Once scanned, the card is activated for use. Although use of bar codes for activation purposes is a significant theft deterrent, keeping track of both the bar code and the magnetic code of each card requires significant manufacturing costs.

Another clever method of accomplishing point-of-sale activation is a package in which the card is carried on a flap that can fold out from the package to expose the magnetic strip. With this package, the card can be fully enclosed within the package until the time of activation. When activation is desired, the flap is opened to swing the card out of the package exposing the magnetic strip, bar code or other similar machine-readable code. In some application, the manipulation necessary to access the machine-readable code is undesirable.

Although all of the above methods of packaging cards for point-of-sale activation have some level of efficacy, an inexpensive package that allows for convenient card activation is still desired.

SUMMARY OF THE INVENTION

The aforementioned problems are overcome by the present invention wherein a wallet card package includes a card that is readily removable from and replaceable into its package. In a preferred embodiment, the package includes one of more panels that define a pouch or sleeve of sufficient size to receive the wallet card. The package also includes a mechanism for detachably securing the wallet card to the package. In a preferred embodiment, the mechanism is a peelable adhesive. In use, the card is removed from the package for activation, for example, by peeling the card away from the package. The card is activated and then rejoined with the card, for example, by inserting the card into the pouch or sleeve.

The package can be configured in a variety of ways to define the pouch or sleeve. In one preferred embodiment, two panels are secured to one another along three sides, leaving the fourth side open to define the mouth of the pouch. In other embodiment, two panels are secured along all four sides and a slot or other similar opening is defined in one of the panels to define the mouth of the pouch.

In a more preferred embodiment, the package defines a control number opening that permits viewing of a control number printed on the packaged wallet card. The opening is aligned with the control number and is formed through whichever panels are necessary to provide viewing when the card is packaged.

In an alternative embodiment, the card is secured to the package by a peelable adhesive and the pouch is eliminated. In use, the card is removed from the peelable adhesive for activation and then pressed back onto the peelable adhesive to rejoin the card and the package.

In another embodiment of the invention, the peelable adhesive is eliminated and the card is initially packaged in the pouch. In use, the card is withdrawn from the pouch for activation and then returned to the pouch to rejoin the card and the package.

The present invention also discloses a method for packaging and activating a wallet card. The method generally includes the steps of (1) providing a wallet card having a machine-readable activation code, (2) removably securing the card to the package in an inactive state with the activation code being inaccessible for reading, (3) removing the card from the package, (4) reading the activation code from the card, and (5) rejoining the card to the package.

The present invention provides a simple and effective wallet card package. The package permits the wallet card to be easily removed from the package, thereby facilitating activation. The package also permits the card to be easily rejoined with the package, thereby reducing the likelihood of loss of the card or the package and also providing aesthetically pleasing packaging for situations when the card is given as a gift. The package is also relatively inexpensive to manufacture and provides a relatively large area for printed information, such as instructions, rates and other related information.

These and other objects, advantages, and features of the invention will be readily understood and appreciated by reference to the detailed description of the preferred embodiment and the drawings.

DETAILED DESCRIPTION OF THE INVENTION

Figure 1:
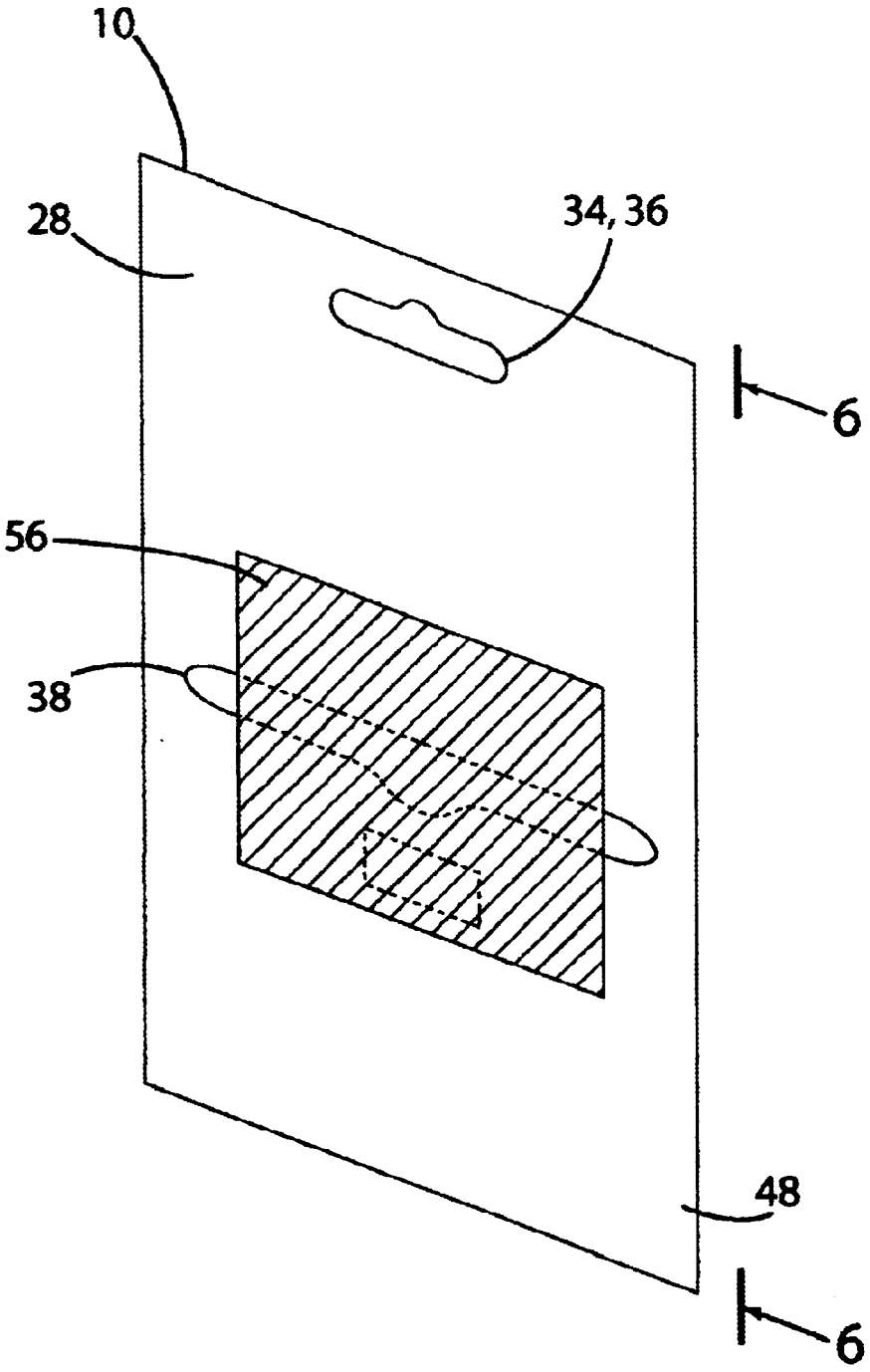
FIG. 1 is a perspective view of a wallet card package according to a preferred embodiment of the present invention.

A wallet card display package according to a preferred embodiment of the present invention is illustrated in FIG. 1, and generally designated 10. The wallet card display package 10 includes a wallet card 56 that is releasably secured to the face of a package 28. The package 28 includes a pouch 38 configured to receive the wallet card 56. In use, the wallet card 56 is first removed from the package 28 for activation (See FIG. 2). The card 56 is activated using conventional techniques and apparatus, for example, by passing the card through a magnetic card reader. After the card 56 has been activated, the card 56 is rejoined to the package 28 by inserting the card 56 into pouch 38 (See FIG. 3).

Figure 8:
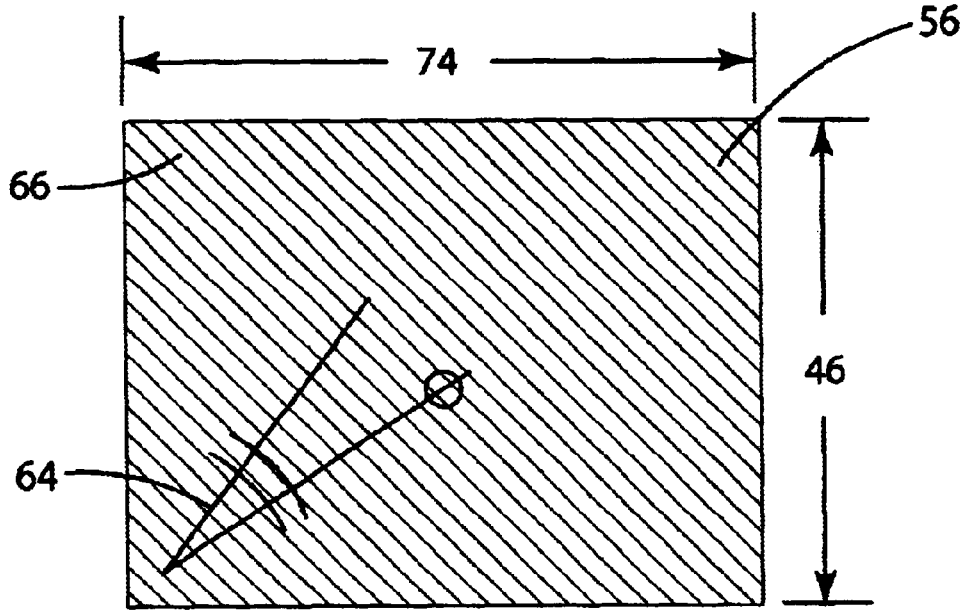
FIG. 8 is a plan view of the front of a typical wallet card.
Figure 9:
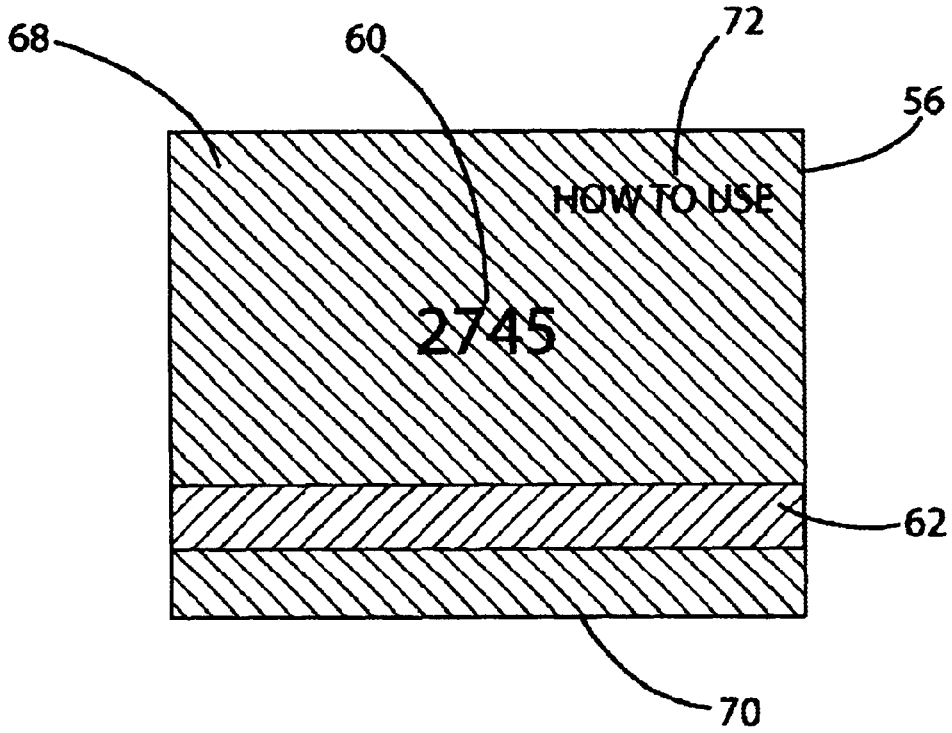
FIG. 9 is a plan view of the back of a typical wallet card.

The present invention is described in connection with a package for a conventional rectangular pre-paid phone card, but is well suited for use with other types of wallet cards as well as wallet cards of other shapes. The wallet card 56, as shown in FIGS. 8 and 9, is generally rectangular, having a long dimension 74 and a short dimension 76, and preferably corresponds in size and shape with standard wallet cards. The wallet card 56 may vary in size and shape from application to application as desired. The wallet card 56 includes a front surface 66 intended primarily to receive graphics 64 and other printed materials, such as the issuer's trademarks and other advertising and promotional information. The wallet card also includes a rear surface 68 intended primarily to receive a magnetic strip 62 and a manufacturing control number 60 as well as printed information, such as a pin number and instructions 72 for use of the card 56. The magnetic strip 62 preferably extends along the rear surface 68 of the card 56 parallel to the bottom edge 70 of the card 56. The magnetic strip 62 is preferably spaced inwardly from the bottom edge 70 of the wallet card 56 a standard distance to permit its use with a conventional card reader (not shown). The manufacturing control number 60 and/or magnetic strip 62 may also be found on the front of the card if so desired. As an alternative to magnetic strip 62, the card 56 may include other machine-readable activation codes, such as a bar code or any other similar code, capable of storing information on a card in a format that is machine readable, whether now available or developed in the future.

Figure 4:
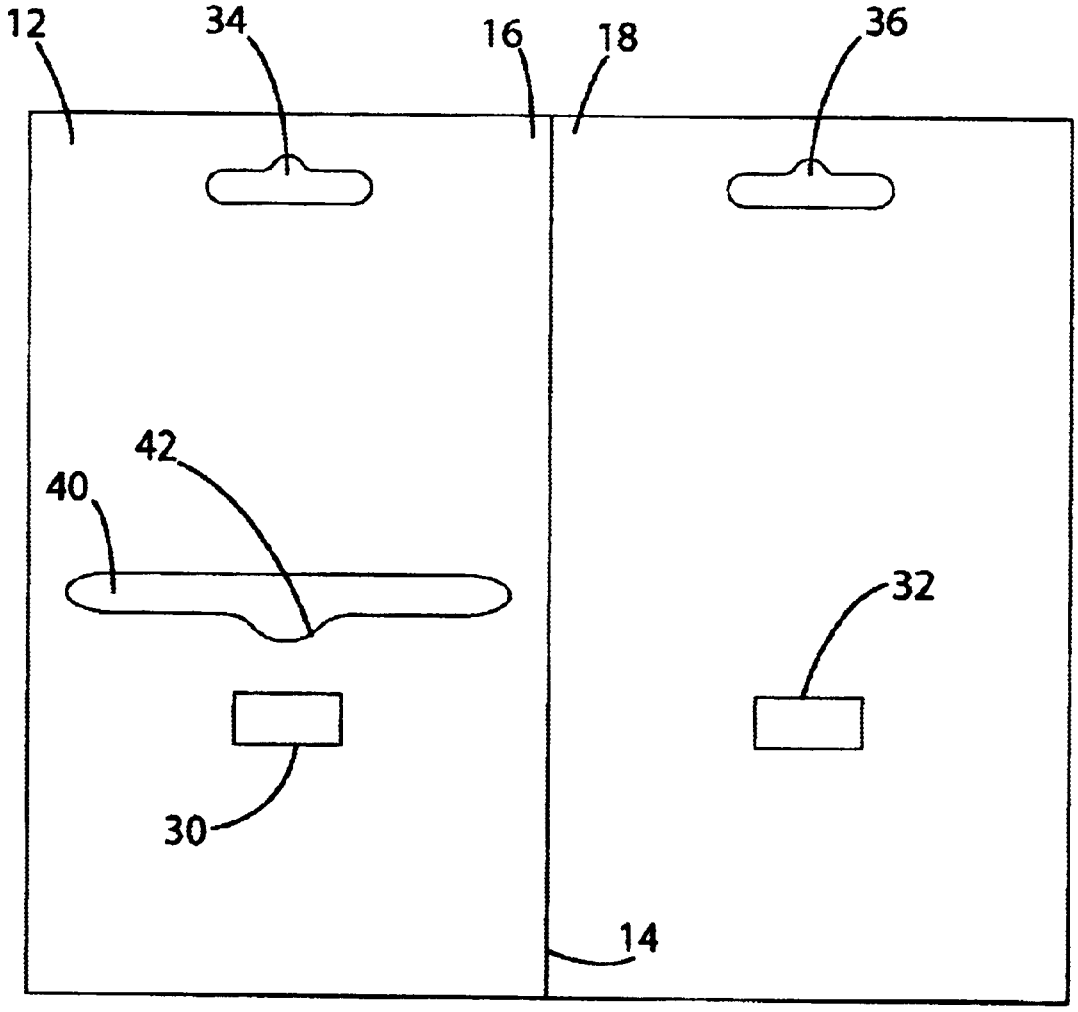
FIG. 4 is a plan view of a blank from which a preferred embodiment of the package is made.

Referring now to FIG. 4, the package 28 generally includes a pair of opposed front 16 and rear 18 panels. The panels 16 and 18 are generally planar, rectangular panels, but may vary is shape from application to application as desired. The panels 16 and 18 are substantially coextensive and are interconnected around their peripheries. The central portion of the panels 16 and 18 are not glued or otherwise secured to one another in a region of sufficient size to receive at least a portion of the card 56. As a result, a pouch 38 is defined in the central portion of the panels. Front panel 16 defines a pouch access slot 40 that provides an opening into the pouch 38 to permit the card 56 to be fitted into the pouch 38 through the front panel 16. Although the access slot 40 is shown in the front panel 16, the access slot 40 may alternatively be formed in the rear panel 18.

The front panel 16 and rear panel 18 each define holes 34 and 36, respectively, that align in the completed package to define a hanging hole for suspending the wallet card display package 10 from a conventional display hook (not shown). Additionally, in applications where a control number is printed on the card 56, the front panel 16 and rear panel 18 each define a pair of openings 30 and 32, respectively, that align in the completed package to define a control number hole that permits viewing of the control number 60 printed on the back 68 of the card 56.

The package 10 is preferably manufactured from a die cut, paperboard blank 12 in which the front panel 16 and rear panel 18 are interconnected along a hinge 14. In the completed package, the hinge 13 extends along the left side of the package 10. The hinge can alternatively extend along any other edge of the package. If desired, the hinge may be eliminated altogether, with the package being formed from two separate panels.

Manufacture

The package 28 is preferably manufactured from a coated or non-coated paperboard material using conventional techniques and apparatus. The stock material is preferably a sheet of paperboard having a thickness of approximately 14 mils (0.014 inches). The stock material and its thickness will vary from application to application depending in part on the desired rigidity of the wallet card and the desired characteristics of the stock material. In conventional applications, the thickness of the stock material will vary from 8 to 28 mils. Although the package 28 is preferably manufactured from a paperboard material, it may be manufactured from other conventional materials, such as polystyrene sheets.

Typically, the packages 28 are cut from sheets of stock material that are large enough to form multiple packages 28. The printed material is preferably printed on the sheet of stock material while the stock material is still in full sheets. The printed materials are printed on the sheet of stock material using conventional techniques and apparatus. The printed sheets are then passed through conventional die cutting apparatus to cut the sheet of stock material into a plurality of blanks, preferably in the form of blank 12 shown in FIG. 4. Preferably, during the die cutting step all necessary cut-outs are removed, including (1) the hanging holes 34 & 36, (2) the control number holes 30 & 32, and (3) the pouch-access slot 40.

Figure 5:
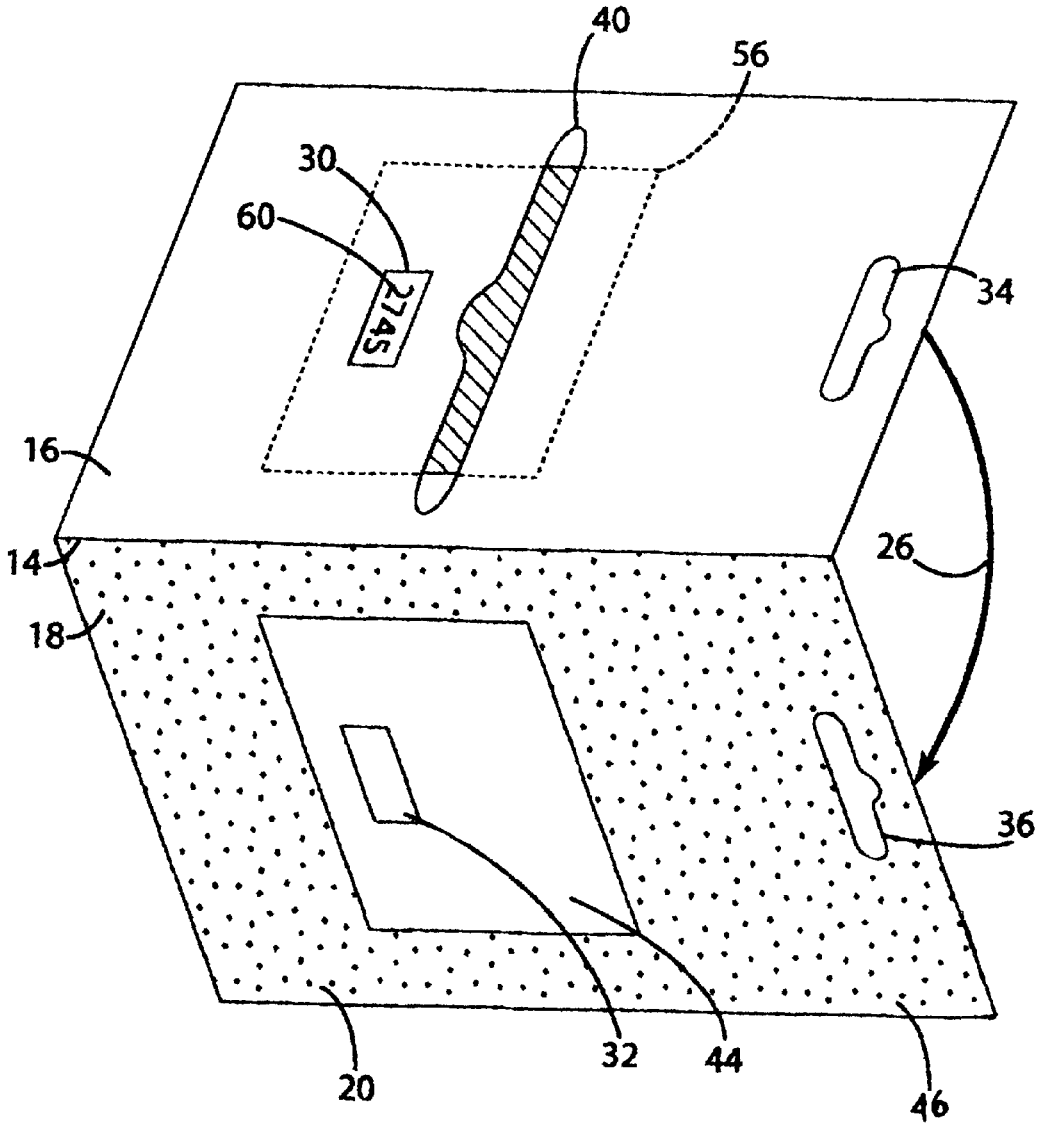
FIG. 5 is a perspective view showing the blank partially folded to form the package.

FIG. 5 depicts the blank 12 being assembled to form the wallet card package 28. As shown by arrow 26, the blank 12 is folded along the hinge 14. Adhesive 20 is applied to an area 46 of the blank 12. However, no adhesive 20 is applied to an area 44 sufficient in size to define the pouch 38 where the card 56 can be disposed. Preferably, the pouch area 44 is situated so that the pouch-access slot 40 does not become glued shut. As also seen in FIG. 5, the card 56 is adhered to the package 28. A wide variety of well known adhesives can be used to intersecure the front and rear panels, such as conventional heat activated adhesives.

The wallet card 56 is preferably manufactured from a plastic material using conventional techniques and apparatus. The stock material is preferably a sheet of polystyrene having a thickness of approximately 30 mils (0.030 inches). The stock material and its thickness will vary from application to application depending in part on the desired rigidity of the wallet card and the desired characteristics of the stock material. In conventional applications, the thickness of the stock material will vary from 10 to 40 mils. Although the card 56 is preferably manufactured from a plastic material, it may be manufactured from other conventional materials, such as coated or non-coated paperboard materials. Similar to the manufacture of the package 28, multiple wallet cards 56 are also typically cut from large sheets of stock material; the printed material is applied to the full sheets of stock material; conventional techniques and apparatus are used; and, the printed sheets are then passed through conventional die cutting apparatus to cut the sheet of stock material into a plurality of wallet cards 56.

The magnetic strip 62 can be applied to the rear surface 68 of the wallet card 58 either before or after the die cutting step. The magnetic strip 62 is applied to the rear surface 68 of the wallet card 56 parallel to the bottom edge 70 of the card 56. The magnetic strip 62 is spaced inwardly from the bottom edge 70 of the wallet card 56 a standard distance to permit its use with a conventional card reader (not shown). After the cards 56 are die cut and the magnetic strip 62 is applied, the cards 56 are passed through a conventional magnetic strip encoder to encode the appropriate information into the magnetic strip 62, such as the telephone number of the issuer's activation system and the activation code for that particular card 56.

The wallet card 56 is releasably secured to the front panel 16, preferably by a peelable adhesive. As used herein, "peelable adhesive" refers to an adhesive characterized by its relatively high shear strength and relatively low peel strength. Peelable adhesives are commonly used to hold credit cards on mailings. In this application, the high shear strength of the peelable adhesive prevents the card from sliding free of the package during shipping or display, while the low peel strength permits the card to be easily peeled away substantially perpendicularly from the package. The preferred adhesive is either a hot melt or a cold glue. A suitable hot melt is available from L&D Adhesives of Comstock Park, Mich. under the trade name INSTANT-LOK. Suitable cold glues include formulated rubber latex available from L&D Adhesives under the trade name National 35-6148 and compounded natural rubber latex available from P-H-X, Inc. Of Milwaukee, Wis. under the trade name PHX 4011. If desired, the wallet card 56 may be secured to the front panel 16 using other conventional techniques and apparatus, such as non-peelable adhesives, staples or other mechanical fasteners.

Activation

Figure 6:
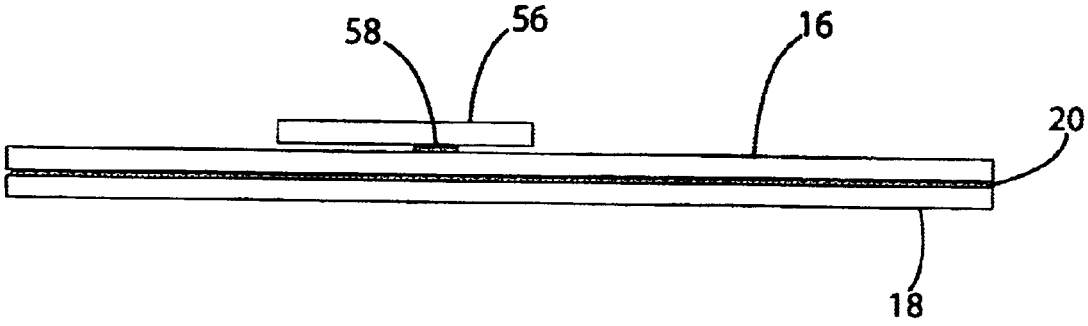
FIG. 6 is a side view of the package as seen in FIG. 1, the thicknesses of the components being exaggerated to more clearly show the subject matter of the present invention.

FIG. 1 and its companion view, FIG. 6, shows the wallet card display package 10. In use, the wallet card display packages 10 are displayed for sale, such as on a display rack in a retail store, where they are visible to the potential purchaser. The package 28 provides an area for graphics and other advertising, promotional and informational materials, both on the front 48 and the back (not shown). As shown in FIG. 6, the two panels 16 & 18 are held together with glue 20. The card 56 is held to the front 48 of the package 28 with a peelable adhesive 58. FIGS. 1 & 6 depict the "before" view of the wallet card display package as it would appear on a store shelf.

Figure 2:
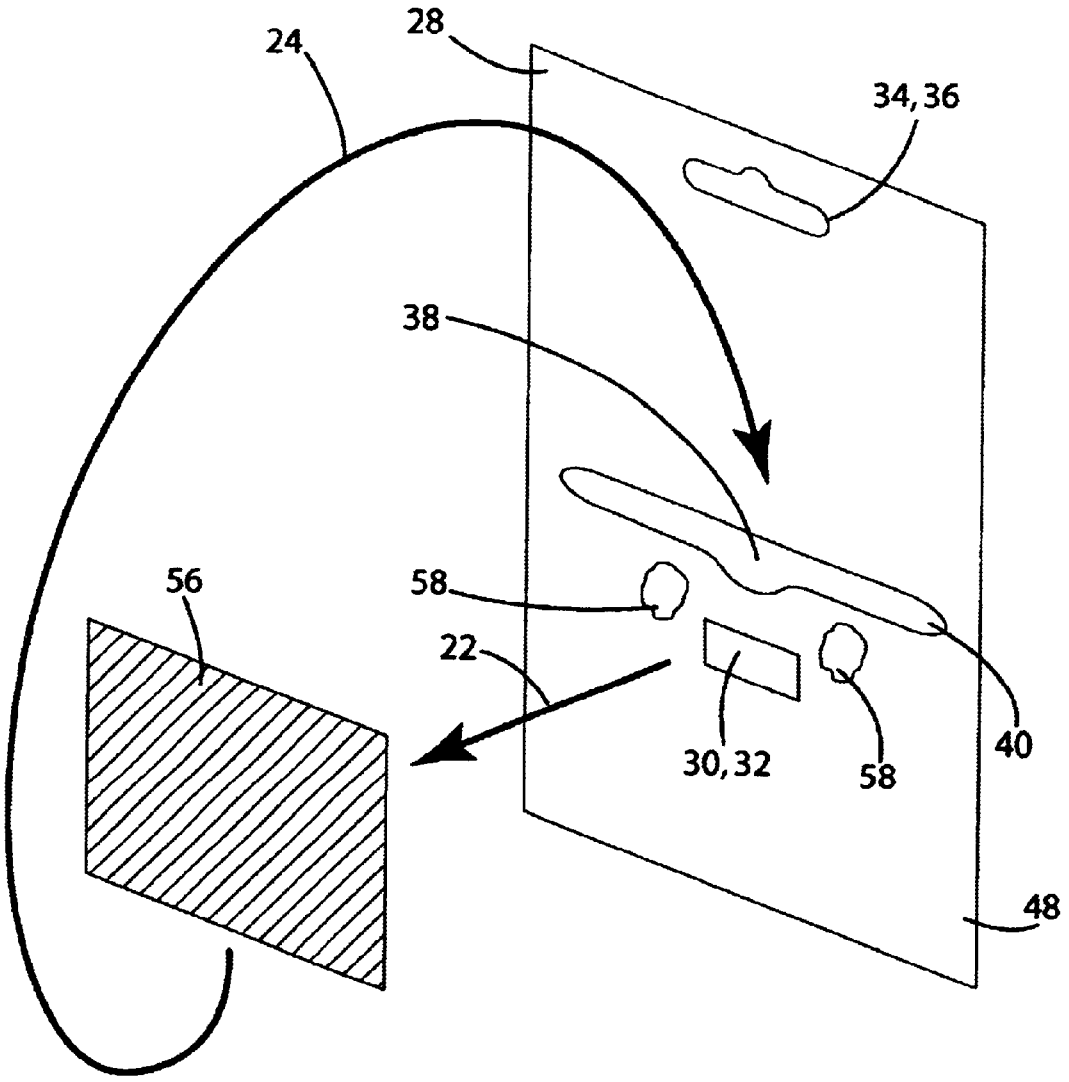
FIG. 2 is a perspective view showing the wallet card removed from its package.

When a wallet card is purchased, the cashier peels the wallet card 56 from the package 28 and swipes the card's magnetic strip 62 through a card reader (not shown). FIG. 2, particularly arrow 22, depicts the action of peeling the card 56 from the package 28. The card's magnetic strip 62 contains encoded information directing the card reader to call the appropriate number and transmit the activation code for the purchased card, thereby activating the card for use by the purchaser. After activation the card 56 can then be inserted into the pouch 38, as shown by arrow 24.

Figure 3:
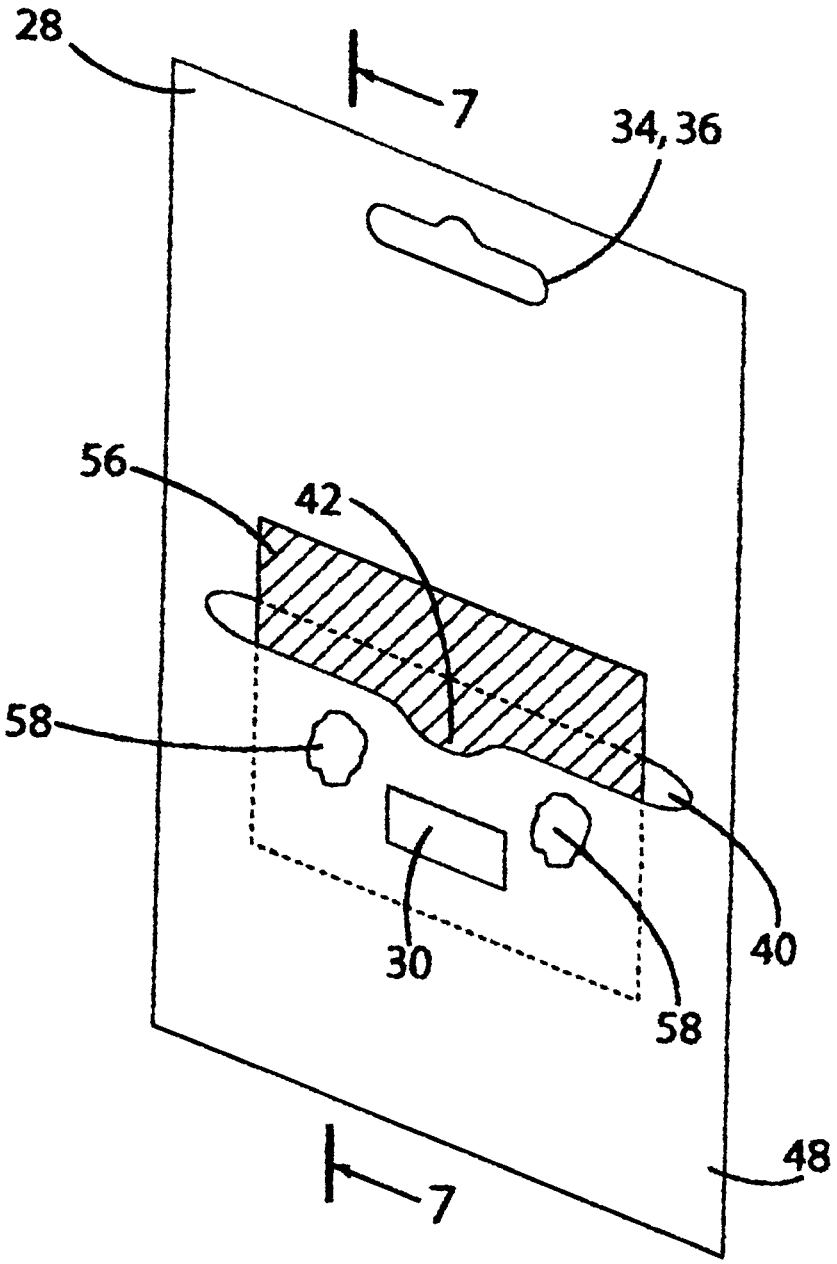
FIG. 3 is a perspective view showing the card replaced into a pouch in its package.
Figure 7:
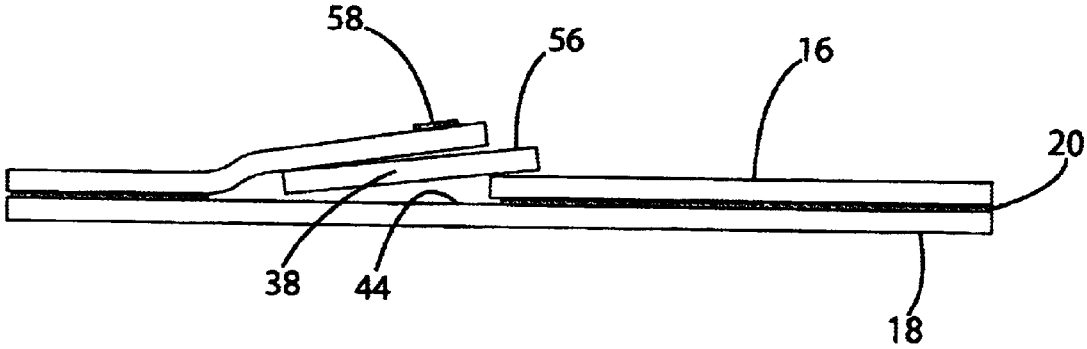
FIG. 7 is a side view of the package as seen in FIG. 3, showing the card replaced into its package, the thicknesses of the components being exaggerated to more clearly show the subject matter of the present invention.

FIG. 3 and its companion view, FIG. 7, shows the "after" view of the wallet card display package 10 after the card 56 has been activated and replaced in its package 28. From FIG. 7 it can be seen how the area lacking glue 44 helps define the pouch 38 for the card 56. The consumer retains both the card 56 and the package 28 when the card 56 is stowed conveniently in the pouch 38. From FIG. 3 it can be seen that the pouch-access slot 40 also contains a curved cutout 42. The cutout 42 is intended as an aid to removing the card 56 from the pouch 38 by providing a thumb-hold. Thicknesses are exaggerated in FIGS. 6 and 7 to highlight details.

Alternative Embodiments

Figure 10:
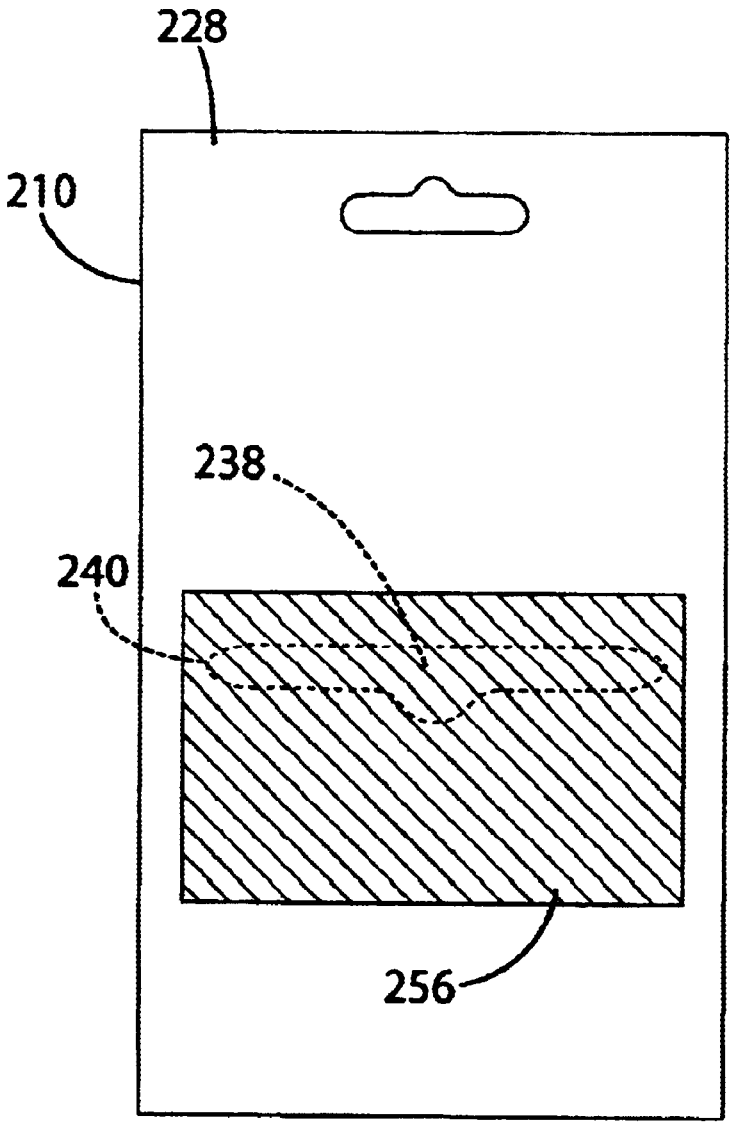
FIG. 10 is a plan view of a first alternative package.

FIG. 10 shows an alternative embodiment of the present invention having an alternative pouch access slot 240 that is hidden from view beneath the card. As seen in FIG. 1, the pouch-access slot 240 of the above described embodiment is partially obscured by the card 256. As shown in FIG. 10, the pouch access slot of this alternative embodiment is substantially short in length so that it is entirely covered by the card 256. In this embodiment the card 256 must be rotated 90 degrees in order to be inserted into the pouch 238.

Figure 11:
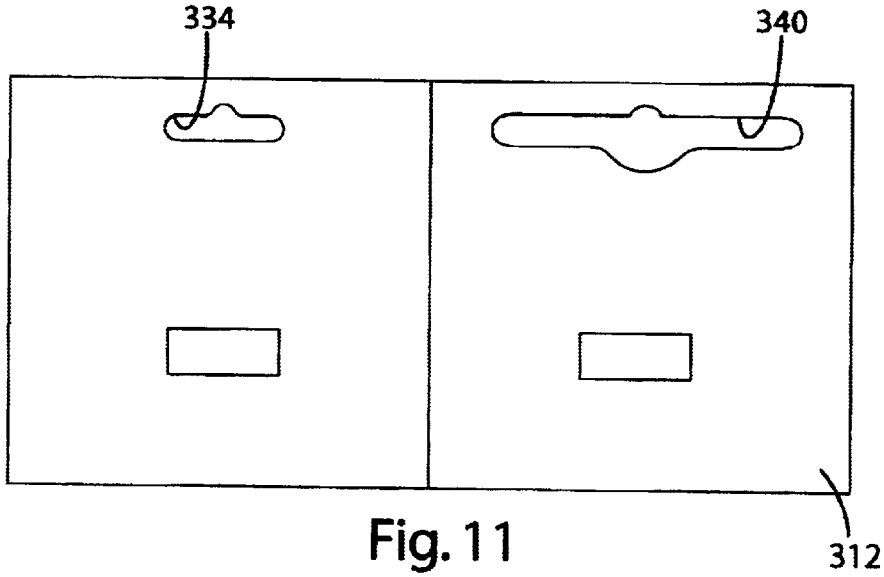
FIG. 11 is a plan view of a blank for a second alternative package.
Figure 12:
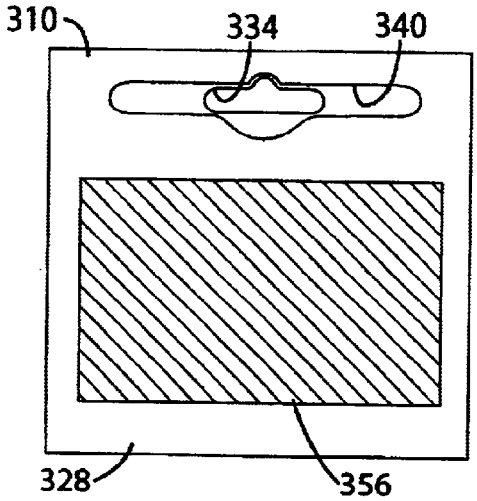
FIG. 12 is a plan view of the second alternative embodiment with the card attached.
Figure 13:
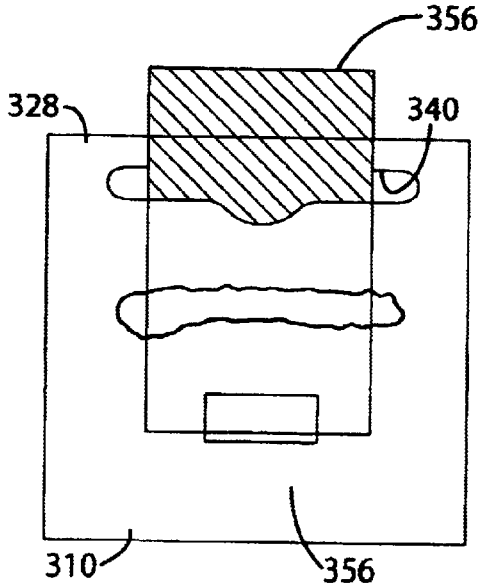
FIG. 13 is a plan view of the second alternative embodiment with the card in the pouch.

Another alternative embodiment is shown in FIGS. 11–13. In this embodiment, the pouch access slot 340 and hanging hole 334 are combined in the same cutout. FIG. 11 shows a blank 312 for this. FIG. 12 shows the wallet card display package 310 with the card 356 adhered to the package 328. FIG. 13 shows the wallet card display package 310 with the card 356 inserted into the pouch 338 through the pouch-access slot 340.

Figure 14:
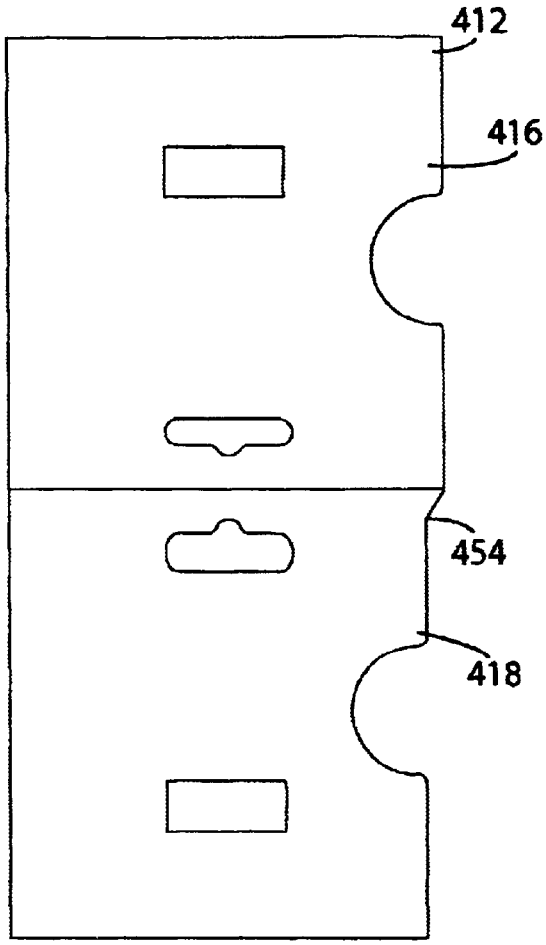
FIG. 14 is a plan view of a blank for a third alternative embodiment.
Figure 15:
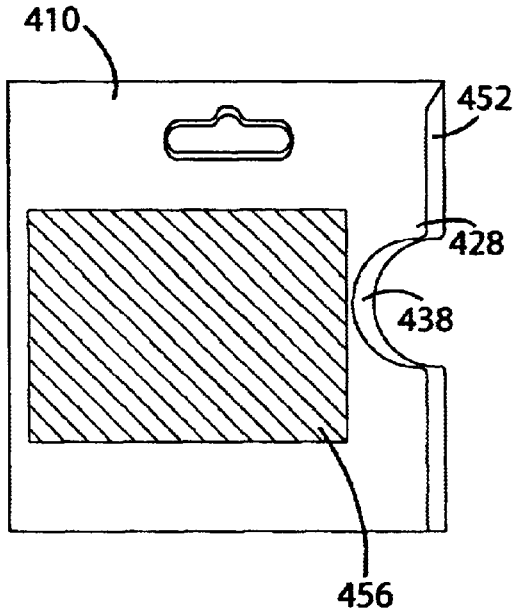
FIG. 15 is a plan view of the third alternative embodiment with the card attached.
Figure 16:
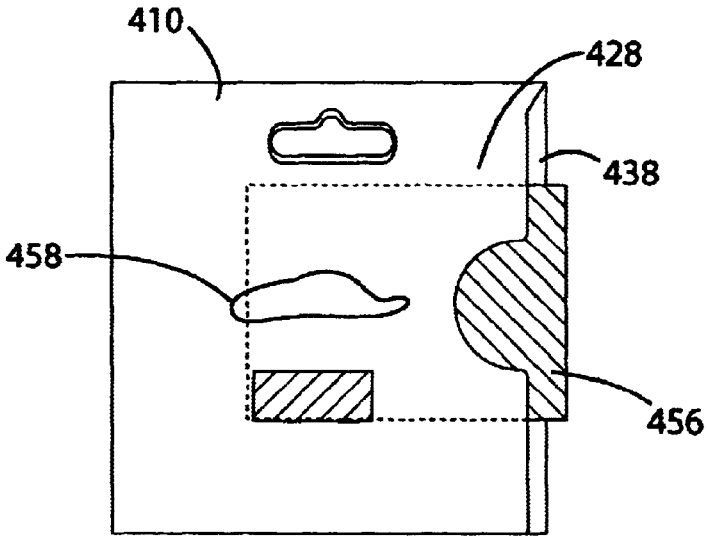
FIG. 16 is a plan view of the third alternative embodiment with the card in the pouch.

Yet another alternative embodiment is shown in FIGS. 14–16. In this embodiment, the mouth of the pouch 438' extends along an edge of the package 410. FIG. 14 shows a blank 412 for this embodiment. FIG. 15 shows a reveal 452 in the front panel 416 for easier access to the pouch 438. An additional cutout 454 for the reveal 452 is shown in FIG. 14. FIG. 15 shows the wallet card display package 410 with the card 456 adhered to the package 428. FIG. 16 shows the wallet card display package 410 with the card 456 inserted into the pouch 438. This embodiment demonstrates that a separate pouch access slot is not needed to create a pouch.

Figures 17, 18:
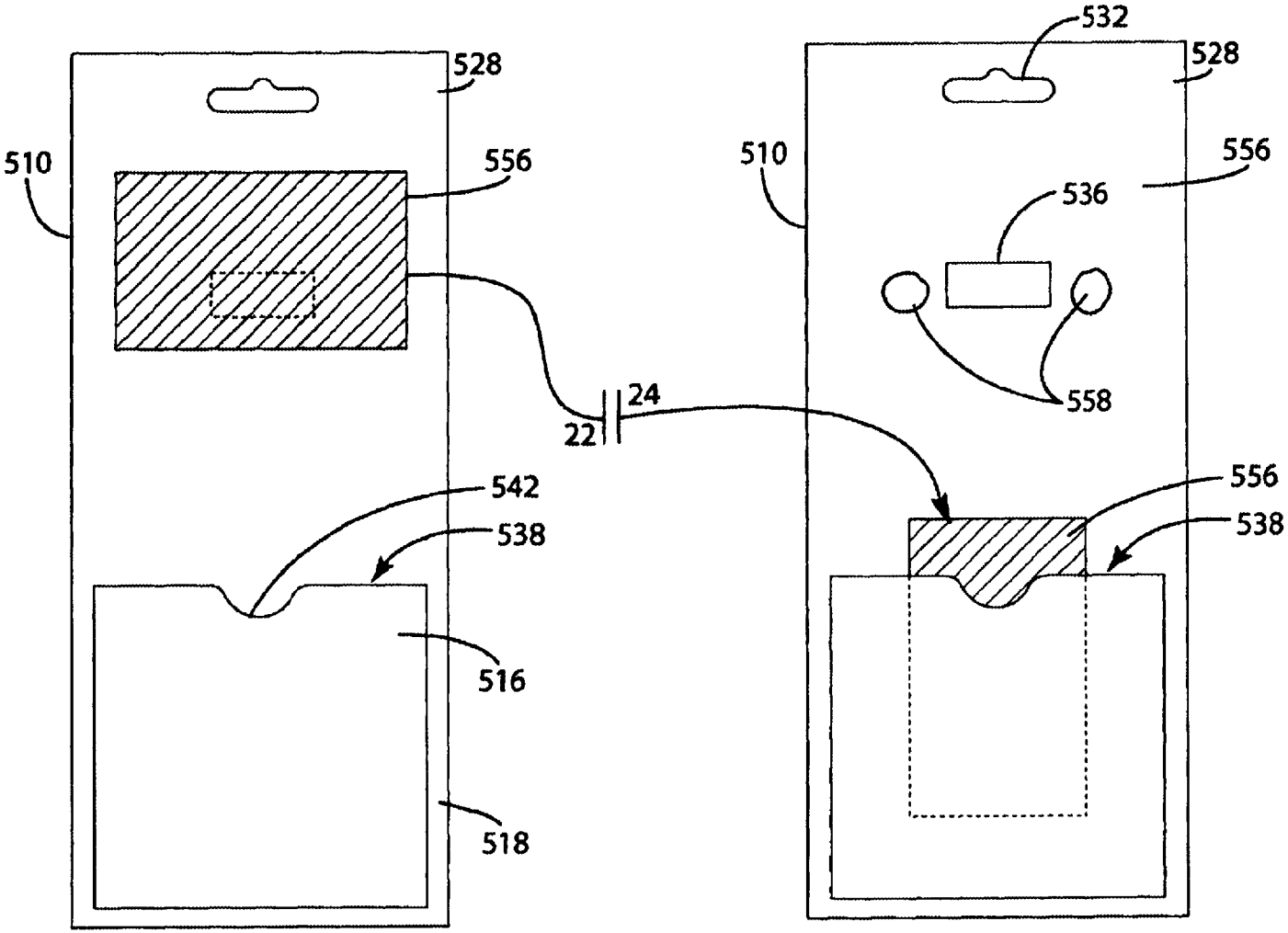
FIG. 17 is a plan view of a fourth alternative embodiment with the card attached.
FIG. 18 is a plan view of that fourth alternative embodiment with the card in the pouch.

FIGS. 17 and 18 depict another alternative embodiment in which the package 528 is assembled from two separate panels 516 and 518. As shown, the panels are not even the same size (although they can be, if desired). As shown, the smaller panel 516 needs no hanging hole or control number hole. There is also no pouch-access slot as the opening to the pouch is defined by the edge of the panel 516. Arrow 22–24 bridges FIGS. 17 and 18 to show the card 556 being removed from the package 528 and replaced into the pouch 538.

In another alternative embodiment, not pictured, the package contains no pouch. Instead the card is peeled from the package and replaced on the package by pressing it back onto the peelable adhesive.

In another alternative embodiment, not pictured, the card is initially packaged in the pouch rather than being adhesively secured to the face of the front panel. The card is removed from the pouch for activation and replaced in the pouch for the customer. In this embodiment, no peelable adhesive or other releasable attachment is necessary.

It should also be noted that although the package shown in each embodiment is rectangular, the package can be manufactured in a multitude of shapes and sizes. Further, the orientation of the card on the package need not be as shown in FIG. 1. For example, the card may alternatively be secured to the package at an angle. Moreover, the orientation of the card in the pouch need not be as shown in FIG. 3, but instead may be at any desired angle.

The above description is that of a preferred embodiment and some alternative embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A wallet card display package for packaging a wallet card during display and sale of the wallet card to customers comprising:

a card being generally wallet-sized and having a machine readable activation code disposed thereon;

a package including surface area for displaying printed materials;

means for releasably securing said card to said package whereby said card is readily detached from said package; and means for rejoining said card to said package, whereby said card can be removed from said package to provide access to said activation code, said activation code can be read from said removed card by a machine for activation of said card and then said card can be rejoined with said package.

2. The wallet card display package as in claim 1 wherein:

said means for releasably securing said card permits said card to be removable from said package without opening and without harming said package.

3. The wallet card display package as in claim 2 wherein:

said means for rejoining said card to said package permits said card to be rejoined to said package without opening and without harming said package.

4. The wallet card display package as in claim 1 wherein said means for releasably securing said card is further defined as a peelable adhesive.

5. The wallet card display package as in claim 4 wherein said means for rejoining said card to said package is further defined as a peelable adhesive.

6. The wallet card display package as in claim 4 wherein said means for rejoining said card to said package is further defined as a card pouch, whereby said card is readily rejoined with said package by placing the card into said pouch.

7. The wallet card display package as in claim 6 wherein said package includes two panels, said panels cooperatively defining said pouch.

8. The wallet card display package as in claim 7 wherein said panels are joined along a fold line.

9. The wallet card display package as in claim 8 further comprising an adhesive disposed between and intersecuring said panels, said adhesive being absent from a region of said panels to define said pouch.

10. The wallet card display package as in claim 9 wherein at least one of said panels defines an access slot cut juxtaposed with said pouch, whereby said access slot provides access to an interior of said access slot.

11. The wallet card display package as in claim 9 wherein said adhesive is absent along at least one peripheral portion of said panels to provide access to said pouch along said peripheral portion.

12. The wallet card display package as in claim 6 wherein said card includes a manufacturing control number, said control number being disposed on a surface of said card facing said package when said card is secured to said package, said package defining a control number hole is substantial alignment with said control number, whereby said control number is visible through said control number hole when said card is secured to said package.

13. The wallet card display package as in claim 10 wherein said pouch-access slot is at least partially disposed behind said card when said card is secured to said package.

14. The wallet card display package as in claim 10 wherein said card is secured to a first of said panels of said package and said pouch-access slot is defined in a second of said panels.

15. The wallet card display package as in claim 10 wherein said package defines a hanging hole permitting said package to be hung from a display hook in a store; and wherein said pouch-access slot is integral with said hanging hole.

16. A method for the sale and activation of a wallet card display package comprising:

manufacturing a package including surface area for displaying printed materials;

manufacturing a generally wallet-sized card having a machine readable activation code disposed thereon;

removably attaching the card to the package, the card being in an inactive state;

displaying the package with the card removably adhered to the package in a retail store; and, upon purchase by consumer:

removing the card from the package, reading the machine readable activation code to activate the card; and rejoining the card with the package.

17. The method of claim 16 wherein said removably attaching step is farther defined as adhering the card to the package by an adhesive.

18. The method of claim 16 wherein said removably attaching step is further defined as adhering the card to the package by a peelable adhesive.

19. The method of claim 18 wherein said rejoining step including the step of pressing the card onto the peelable adhesive.

20. The method of claim 18 wherein said package manufacturing step includes the steps of manufacturing the package with a pouch capable of receiving the card, said rejoining step including the step of inserting the card into the pouch.

21. The method of claim 16 wherein said package manufacturing step comprises includes the step of manufacturing the package with a pouch capable of receiving the card;

said removably attaching step including placing the card into the pouch; and, said card rejoining step including replacing the card into the pouch.

22. The method of claim 20 wherein said package manufacturing step includes:

forming the package from a single blank, said forming step including folding the blank at least once to create at least two adjacent panels; and, gluing the panels together, placing no glue in an area between the panels to define the pouch.

23. The method of claim 20 wherein said package manufacturing step includes:

forming the package from at least two separate panels;

gluing the two panels together, placing no glue in an area between the panels to define the pouch.

24. The method of claim 23 wherein said package manufacturing step includes cutting a pouch-access slot in at least one of the panels, whereby the pouch is accessible for card insertion.

25. The method of claim 24 wherein said package manufacturing step includes defining a control number hole in the package to permit viewing of a manufacturing control number on the card.

26. A wallet card display package comprising:

a front panel;

a rear panel disposed adjacent the front panel;

a wallet card including a machine readable activation code; and means for releasably securing said wallet card to said front panel with said activation code being inaccessible for reading;

wherein said front panel and said rear panel cooperatively defining a pouch, said pouch being of sufficient size to receive said wallet card, whereby said card is readily removed from said front panel to permit said activation code to be read by a machine and readily rejoined to said package by insertion of said card into said pouch.

27. The wallet card display package of claim 26 wherein said means for releasably securing is further defined as an adhesive.

28. The wallet card display package of claim 27 wherein said means for releasably securing is further defined as a peelable adhesive.

29. The wallet card display package of claim 28 wherein at least one of said front panel and said rear panel defines an access slot providing access to said pouch.

30. The wallet card display package of claim 28 wherein said front panel defines an access slot providing access to said pouch, said card having a width, said access slot having a width lesser than said width of said card, whereby said access slot is hidden by card.

31. The wallet card display package of claim 28 wherein said card include a manufacturing control number, said package defining a control number hole, said card being releasably secured to said front panel with said control number in substantial alignment with said control number hole such that said control number is visible.

32. The wallet card display package of claim 31 wherein said package defines a hanging hole for suspending said package from a display hook.

33. The wallet card display package of claim 32 wherein said hanging hole is integral with said access slot.

34. The wallet card display package of claim 26 wherein said front panel and said rear panel are joined along a fold line.

35. The wallet card display package of claim 34 wherein adhesive is disposed between said panels, said adhesive being absent in a region to define said pouch.

* * * * *